US006930239B1

(12) United States Patent
Chen

(10) Patent No.: US 6,930,239 B1
(45) Date of Patent: Aug. 16, 2005

(54) GROUND BAR

(76) Inventor: Kuo-Hsiung Chen, No. 52, Jingjian 2nd Rd., Guanyin Township, Taoyuan Hsien (TW)

( * ) Notice: Subject to any disclaimer, the term of this patent is extended or adjusted under 35 U.S.C. 154(b) by 0 days.

(21) Appl. No.: 10/848,854

(22) Filed: May 18, 2004

(51) Int. Cl.[7] ..... H01R 4/66
(52) U.S. Cl. ..... 174/7; 174/3; 361/222
(58) Field of Search ..... 174/1, 2, 3, 5 R, 174/5 SG, 6, 7; 361/216, 219, 220, 222

(56) References Cited

U.S. PATENT DOCUMENTS 1,980,020 A * 11/1934 Webster ..... 174/7
2,060,151 A * 11/1936 Wayman ..... 174/7
2,157,180 A * 5/1939 Little ..... 174/7
2,186,482 A * 1/1940 Frank ..... 174/7
2,188,124 A * 1/1940 Tryce ..... 174/7
2,207,134 A * 7/1940 Staples ..... 174/7
2,366,997 A * 1/1945 Brand ..... 174/6
3,522,359 A * 7/1970 Marshall ..... 174/7
3,566,000 A * 2/1971 Maurer et al. ..... 174/7
3,633,068 A * 1/1972 Miller ..... 361/222
3,716,649 A * 2/1973 Smith et al. ..... 174/7
3,742,300 A * 6/1973 Floyd ..... 361/222
3,817,852 A * 6/1974 Toedtman et al. ..... 174/7
4,156,793 A * 5/1979 Carlson ..... 174/7
4,577,053 A * 3/1986 Kies ..... 174/7
5,924,315 A * 7/1999 Chang ..... 70/209
6,137,049 A * 10/2000 Hecock ..... 174/7
6,815,606 B1 * 11/2004 Chung ..... 174/3

* cited by examiner

*Primary Examiner*—Dean A. Reichard
*Assistant Examiner*—Adolfo Nino

(57) ABSTRACT

A ground bar includes a bar, a head securely connected to a first end of the bar, and a cap securely connected to a second end of the bar. The head is composed of a solid cone and a hollow sleeve securely connected to the solid cone and having a diameter larger than a diameter of the bar in such way that the outer periphery of the bar is protected so that after the head is extended into the ground, the outer periphery of the bar is protected from damage. The outer periphery of the hollow sleeve has slits defined thereon for guiding dirt.

14 Claims, 12 Drawing Sheets

GROUND BAR

BACKGROUND OF THE INVENTION

1. Field of the Invention

The present invention relates to a ground bar, and more particularly to a ground bar that maintains completeness of its outer periphery so as to effectively guide abnormal electrical currents to the ground.

2. Description of Related Art

A ground bar is designed to guide abnormal electrical current, such as lightning, to the ground to prevent any damage to the electrical appliance from the abnormal electrical current. With reference to FIGS. 1, 2, and 2A, a conventional ground bar is introduced and has a stick 2, a cap 3 securely mounted on top of the stick 2 and a conical head 4 securely mounted on a bottom end of the stick 2. In order to effectively guide the electrical current to the ground by the so-called "skin effect", the material for the cap 3 and the conical head 4 preferably is metal. Further a brass layer 7 is plated onto the outer periphery of the stick 2. It is to be noted that the conical head 4 has a diameter the same as that of the stick 2 and of the cap 3 and therefore when the ground bar of this conventional type is hammered into the ground for practical application, fracture may occur on the outer periphery of the brass layer 7 due to hard rocks to thus cause moisture to seep into a space between the brass layer 7 and stick 2 which is preferably made of stainless steel. Thus, "galvanic erosion" will cause the periphery of the stick 2 to swell. Due to the swell of the stick periphery, the brass layer 7 is broken and therefore the electricity guiding function of the conventional ground bar is deteriorated. Besides, the leakage of chemical solution from the brass plating process as a consequence of the broken brass layer 7 will cause serious environment problem.

From the aforementioned description, it is noted that the conventional ground bar has the following disadvantages: (1) the grounding function is lost after the outer periphery of the brass layer 7 is damaged and (2) because the damage to the outer periphery of the brass layer 7 causes the ground bar to reduce its originally designed function, the operator has to replace a new ground bar and thus the cost is high.

To overcome the shortcomings, the present invention intends to provide an improved ground bar to mitigate the aforementioned problems.

SUMMARY OF THE INVENTION

The primary objective of the invention is to provide a ground bar that can smoothly extend into the ground and protect the outer periphery of the brass layer intact in such a way that the electricity guiding function of the ground bar is maintained.

Another objective of the invention is to provide a ground bar wherein the diameter of the brass layer is uniform and does not cause environment problem.

Other objects, advantages and novel features of the invention will become more apparent from the following detailed description when taken in conjunction with the accompanying drawings.

DETAILED DESCRIPTION OF PREFERRED EMBODIMENTS

Figure 1:
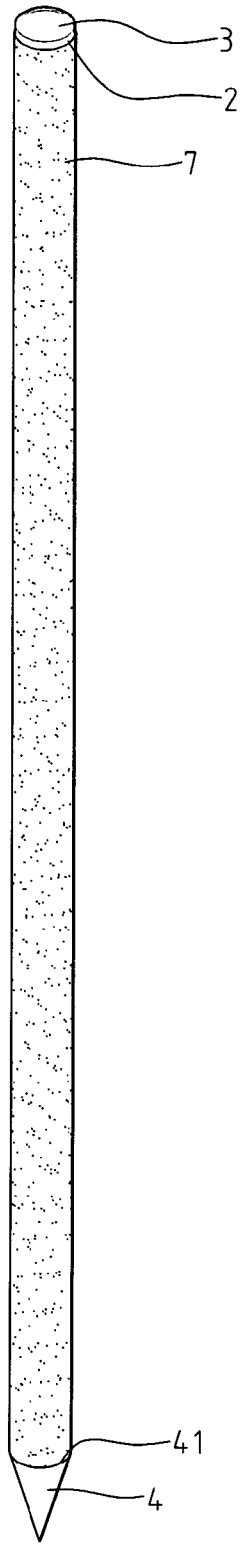
FIG. 1 (Prior Art)
FIG. 1 is a perspective view of a conventional ground bar.
Figure 2A:
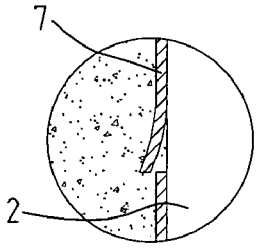
FIG. 2A is a schematic view showing the damage to the outer periphery of the brass layer.
Figure 2:
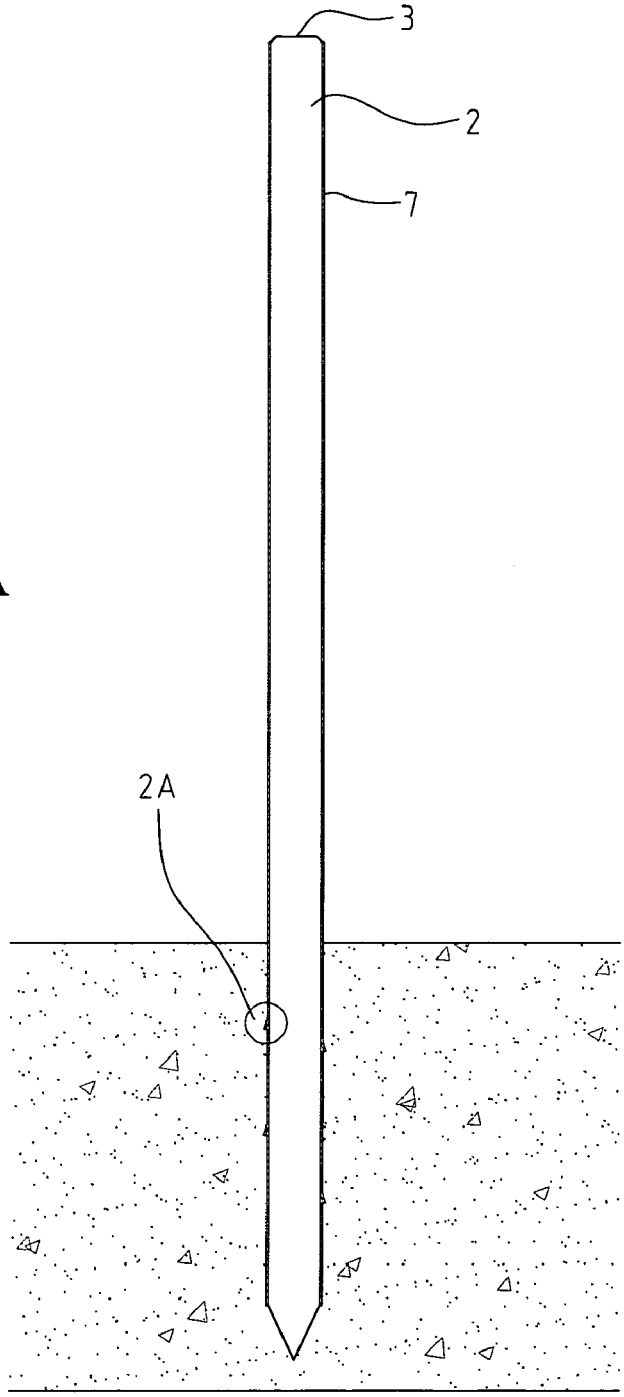
FIG. 2 (Prior Art)
FIG. 2 is a schematic side view showing the application of the conventional ground bar.
Figure 3:
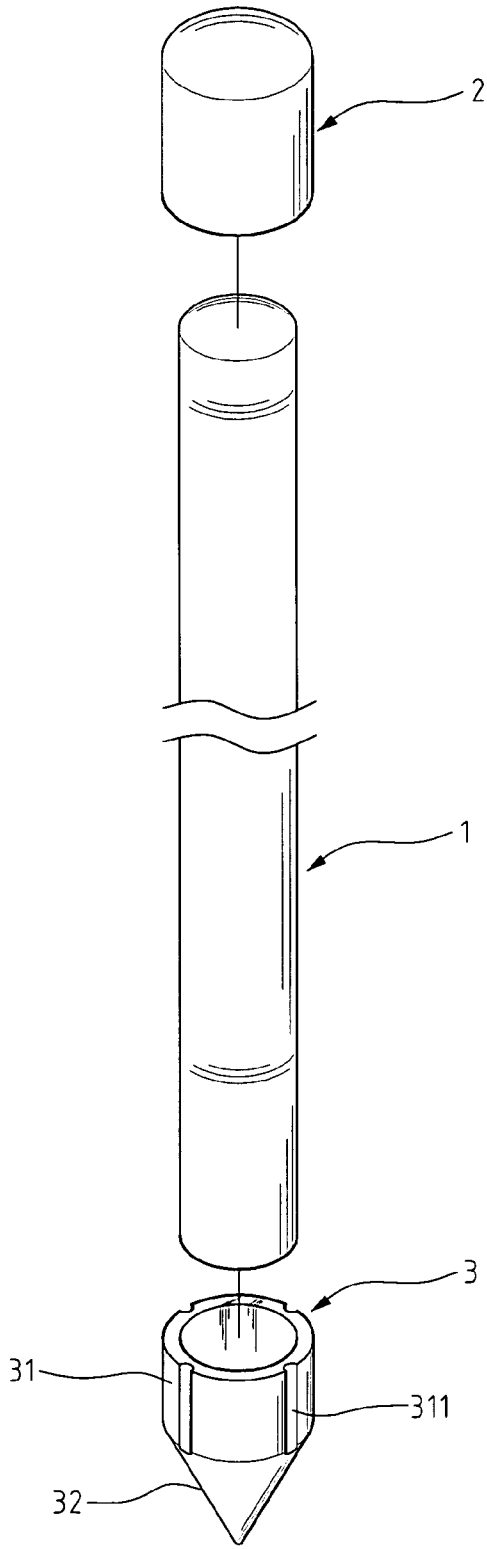
FIG. 3 is an exploded perspective view of a ground bar in accordance with a first embodiment of the present invention.
Figure 3A:
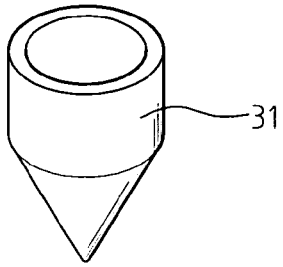
FIGS. 3A–3G are perspective views of different shapes of a conical heads of the ground bar of the present invention.
Figure 3B:
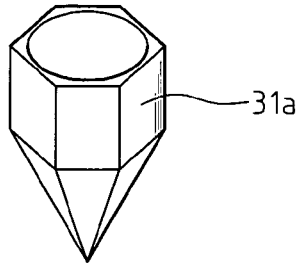
Figure 3C:
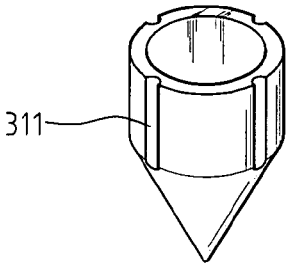
Figure 3D:
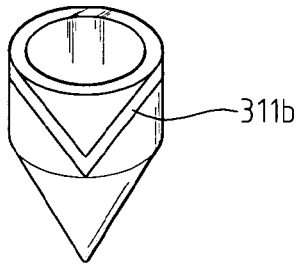

With reference to FIG. 3, a ground bar in accordance with the present invention comprises a bar 1, a cap 2, and a head 3. The bar 1 is made of metal and has a first end to be connected to the head 3 and a second end to be connected to the cap 2.

The head 3 is a combination of a sleeve 31 and a cone 32. The sleeve 31 is hollow and has multiple slits 311 longitudinally defined in the outer periphery of the sleeve 31. The cone 32 is solid. The sleeve 31 further has an outer diameter larger than the diameter of the bar 1.

Figure 3E:
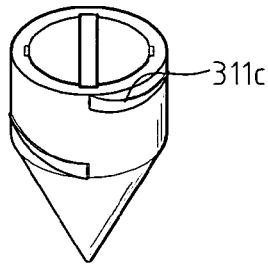
Figure 3F:
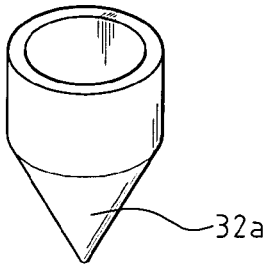
Figure 3G:
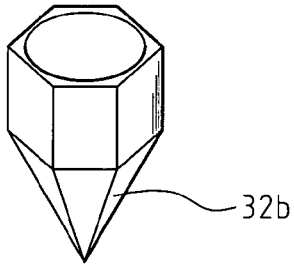

With reference to FIGS. 3A–3G, the sleeve 31 may assume different cross-sectional shape, such as a cylinder having a smooth outside periphery (reference 31, FIG. 3A), or having a polygonal outer periphery (reference 31*a*, FIG. 3B), or having a smooth outer periphery with a pattern which may be slits 311 (FIG. 3C), V-shaped slits 311*b* (FIG. 3D) or a spiral slit 311*c* (FIG. 3E). Also, the cone 32 may have a smooth outer periphery 32*a* (FIG. 3F) or a polygonal outer periphery 32*b* (FIG. 3G).

Figure 4:
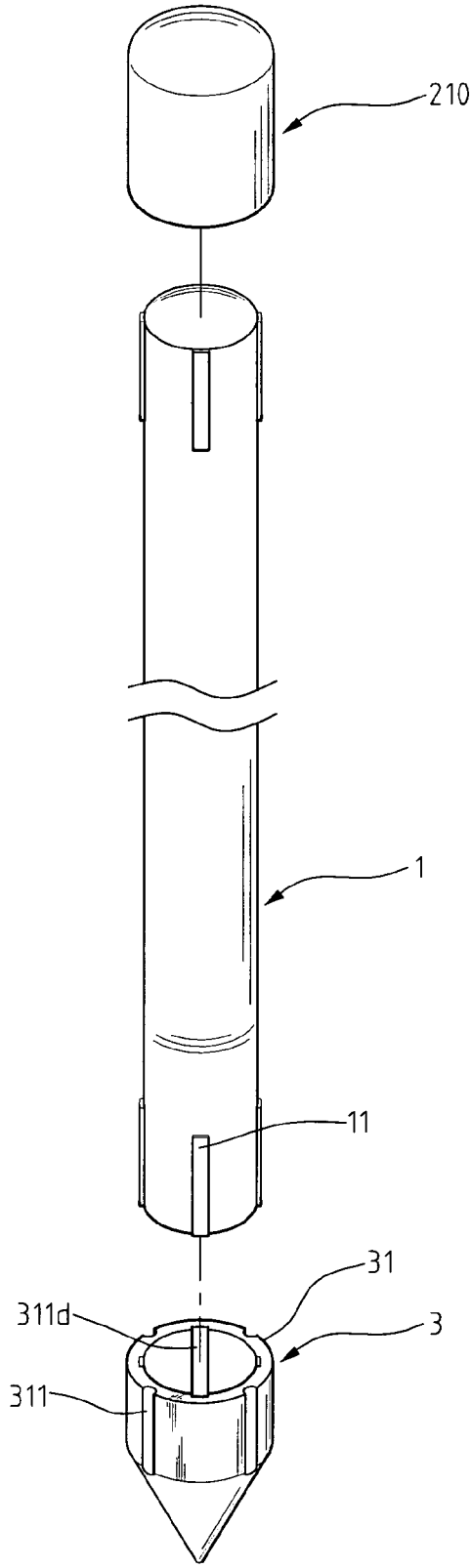
FIG. 4 is an exploded view of a ground bar in accordance with a second embodiment of the present invention.
Figure 5:
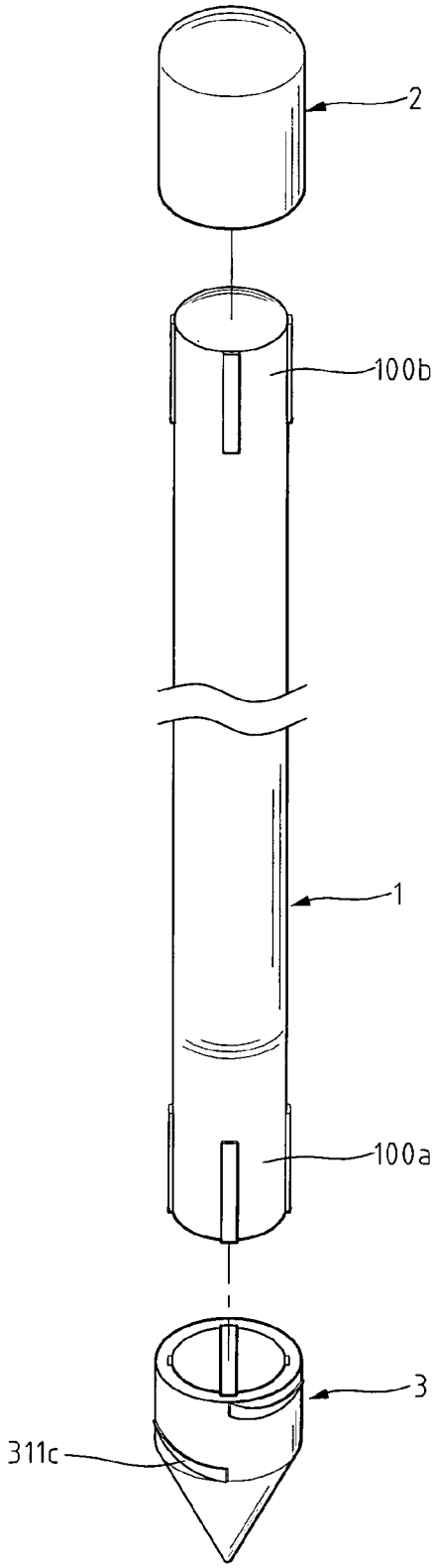
FIG. 5 is an exploded view of a ground bar in accordance with a third embodiment of the present invention.
Figure 6A:
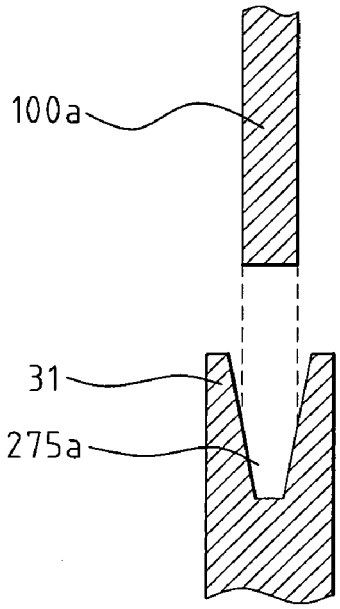
FIG. 6A is a cross-sectional view showing the combination of a front end of the ground bar and a sleeve.
Figure 6B:
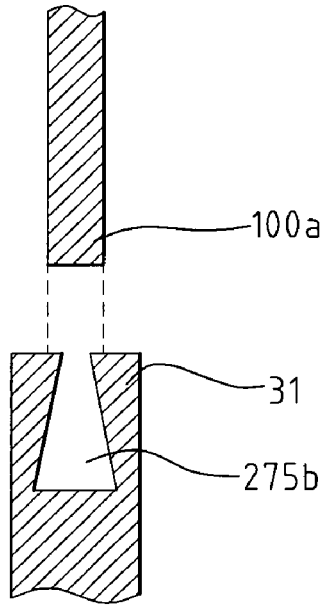
FIG. 6B is a cross-sectional view showing the combination of a rear end of the ground bar and a sleeve of a different configuration.
Figure 7A:
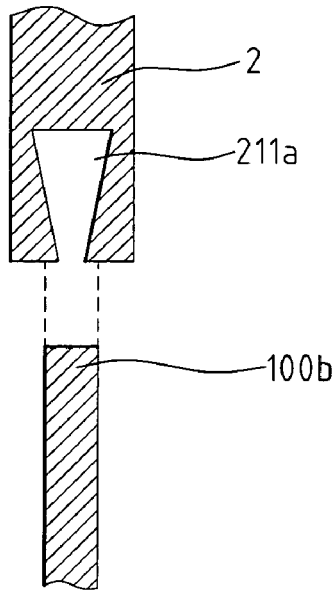
FIG. 7A is a cross-sectional view showing the combination of the front end of the bar and the sleeve.
Figure 7B:
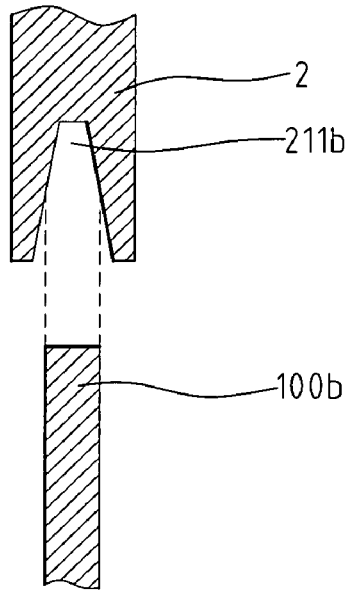
FIG. 7B is a cross-sectional view showing the combination of the rear end of the bar and the sleeve of a different configuration.

With reference to FIG. 4, the bar 1 may have elongated protrusions 11 longitudinally formed on the outer periphery of the bar 1. The sleeve 31 further has inner slits 311*d* beside the outer slits 311. The inner slits 311*d* are defined in the inner periphery of the sleeve 31 to correspond to the elongated protrusions 11 so that when the first end of the bar 1 is extended into the hollow sleeve 31, the mutually mated relationship between the elongated protrusions 11 and the inner slits 311*d* secures the engagement between the first end of the bar 1 and the head 3. It is to be noted that the bar 1 has a diameter smaller than the diameter of the head 3 and the diameter of the cap 2 so that after the cap 2 is securely mounted on a second end of the bar 1 and the first end of the bar 1 is securely extended into the sleeve 31 of the head 3 and after the ground bar of the present invention is extended into the ground, the various diameter ratio ensures that the outer periphery of the bar 1 is intact.

With reference to FIGS. 5, 6A, 6B, 7A, and 7B, the first end 100*a* of the bar 1 is designed to have a diameter smaller than that of the sleeve 31 which has in inner space configured to have a trapezoidal shape in cross section 275*a*, 275*b*. Further, the cap 2 has an inner space with a trapezoidal cross section 211*a* or 211*b* to correspond to the second end 100*b* of the bar 1.

Figure 8:
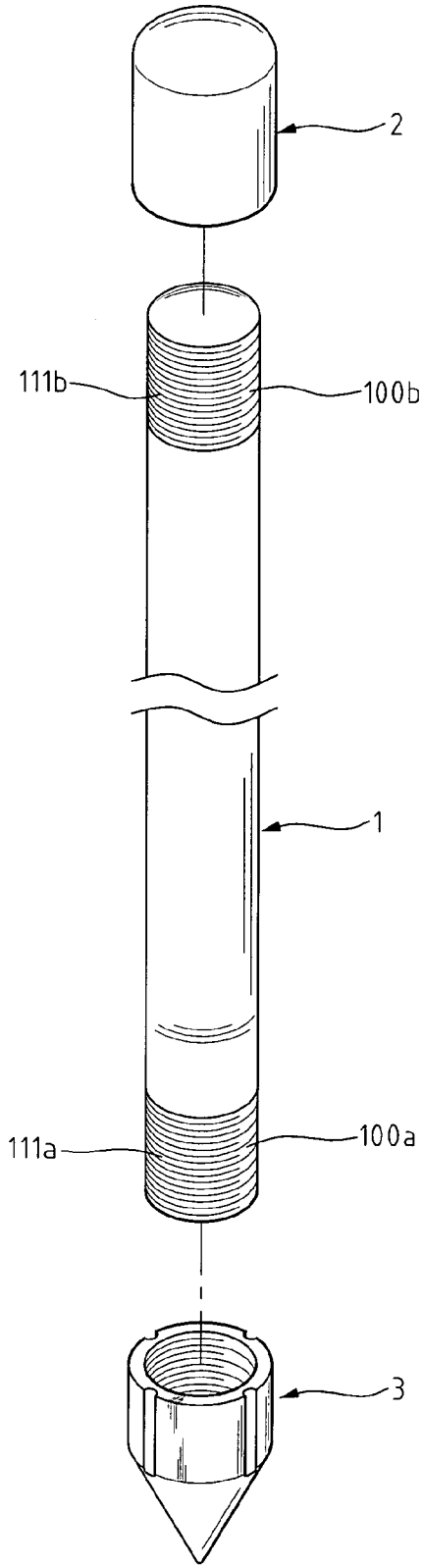
FIG. 8 is an exploded view of a ground bar in accordance with a different embodiment of the present invention.
Figure 9:
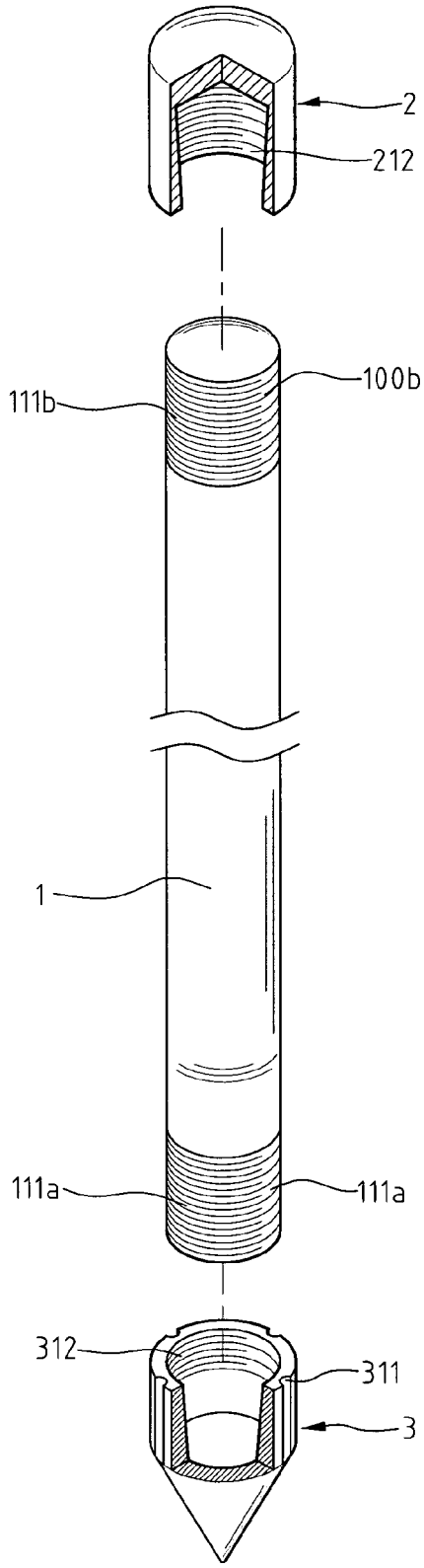
FIG. 9 is an exploded view, partially broken, of the ground bar shown in FIG. 8.

With reference to FIGS. 8 and 9, it is noted that the first end 100*a* and the second end 100*b* of the bar 1 are provided with a threading 111*a*, 111*b* respectively corresponding to the inner threading 312, 212 of the head 3 and the cap 2 respectively so that the bar 1 is able to securely connected to the head 3 and the cap 2.

Figure 10:
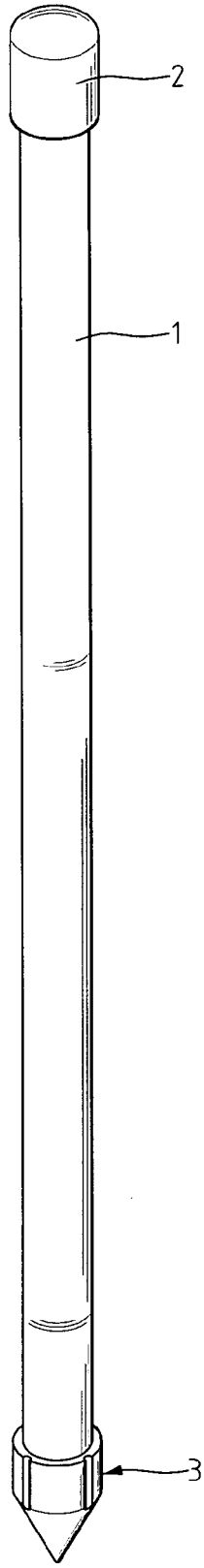
FIG. 10 is a perspective view showing the ground bar of the present invention.
Figure 11:
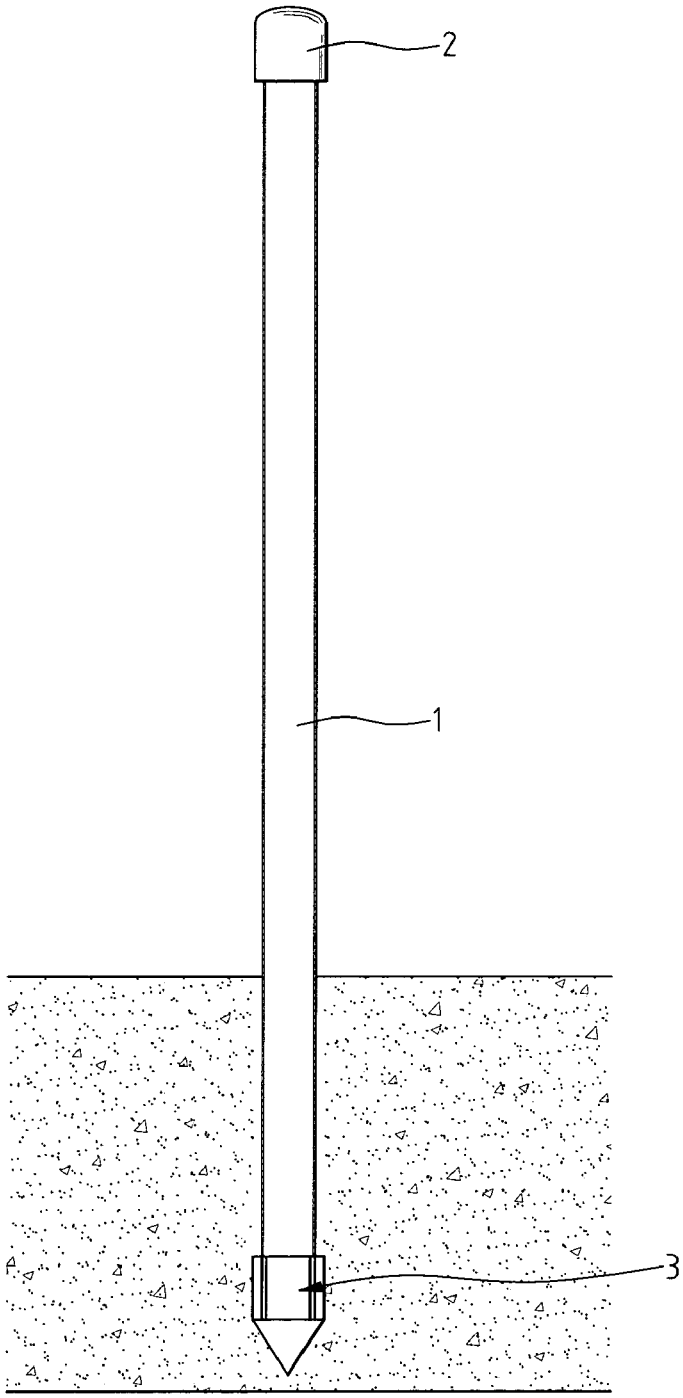
FIG. 11 is a schematic view showing the application of the ground bar of the present invention.

With reference to FIGS. 9 and 10, after the cap 2 is securely connected to the second end of the bar and the head 3 is securely connected to the head 3, the ground bar of the present invention is ready for application. After the ground bar of the present invention is extended into the ground, because the sleeve 31 of the head 3 has a diameter larger than that of the bar 1, the outer periphery of the bar 1 is protected from damage. Furthermore, due to the slits 311 in the outer periphery of the sleeve 31, dirt is guided along the slits 311 and thus a protection layer is formed surrounding the outer periphery of the bar 1 to further protect the outer periphery of the bar 1.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ground bar comprising:

a bar having first and second ends;

a head securely connected to the first end of the bar, the head having a solid cone and a hollow sleeve securely connected to the solid cone and a diameter larger than a diameter of the bar for protecting the outer periphery of the bar; and a cap securely connected to the second end of the bar;

wherein slits are defined in the outer periphery of the hollow sleeve for guiding dirt.

2. The ground bar as claimed in claim 1, wherein the bar has elongated protrusions formed on the outer periphery of the bar to correspond to inner slits defined in the inner periphery of the hollow sleeve.

3. The ground bar as claimed in claim 2, wherein the first end and the second end of the bar are provided with a threading respectively to correspond to inner threading defined in the inner periphery of the hollow sleeve and the cap.

4. The ground bar as claimed in claim 1, wherein the hollow sleeve has an inner space with a trapezoidal cross section and the cap has an inner space with a trapezoidal cross section to correspond to the first and second ends of the bar respectively.

5. The ground bar as claimed in claim 1, wherein the first end and the second end of the bar are provided with a threading respectively to correspond to inner threading defined in the inner periphery of the hollow sleeve and the cap.

6. A ground bar comprising:

a bar having first and second ends;

a head securely connected to the first end of the bar, the head having a solid cone and a hollow sleeve securely connected to the solid cone and a diameter larger than a diameter of the bar for protecting the outer periphery of the bar; and a cap securely connected to the second end of the bar;

wherein V-shaped slits are defined in the outer periphery of the hollow sleeve.

7. The ground bar as claimed in claim 6, wherein the hollow sleeve has an inner space with a trapezoidal cross section and the cap has an inner space with a trapezoidal cross section to correspond to the first and second ends of the bar respectively.

8. The ground bar as claimed in claim 7, wherein the first end and the second end of the bar are provided with a threading respectively to correspond to inner threading defined in the inner periphery of the hollow sleeve and the cap.

9. A ground bar comprising:

a bar having first and second ends;

a head securely connected to the first end of the bar, the head having a solid cone and a hollow sleeve securely connected to the solid cone and a diameter larger than a diameter of the bar for protecting the outer periphery of the bar; and a cap securely connected to the second end of the bar;

wherein a spiral slit is defined in the outer periphery of the hollow sleeve.

10. The ground bar as claimed in claim 9, wherein the bar has elongated protrusions formed on the outer periphery of the bar to correspond to inner slits defined in the inner periphery of the hollow sleeve.

11. The ground bar as claimed in claim 10, wherein the first end and the second end of the bar are provided with a threading respectively to correspond to inner threading defined in the inner periphery of the hollow sleeve and the cap.

12. The ground bar as claimed in claim 9, wherein the hollow sleeve has an inner space with a trapezoidal cross section and the cap has an inner space with a trapezoidal cross section to correspond to the first and second ends of the bar respectively.

13. The ground bar as claimed in claim 12, wherein the first end and the second end of the bar are provided with a threading respectively to correspond to inner threading defined in the inner periphery of the hollow sleeve and the cap.

14. The ground bar as claimed in claim 9, wherein the first end and the second end of the bar are provided with a threading respectively to correspond to inner threading defined in the inner periphery of the hollow sleeve and the cap.

* * * * *